US009706313B2

(12) United States Patent
Bürger

(10) Patent No.: US 9,706,313 B2
(45) Date of Patent: Jul. 11, 2017

(54) HEARING AID DEVICE

(71) Applicant: Oticon A/S, Smørum (DK)

(72) Inventor: Christian C. Bürger, Holte (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/697,755

(22) Filed: Apr. 28, 2015

(65) Prior Publication Data

US 2015/0319541 A1 Nov. 5, 2015

(30) Foreign Application Priority Data

Apr. 29, 2014 (EP) ..... 14166359

(51) Int. Cl.
*H04R 25/00* (2006.01)
*H04R 1/28* (2006.01)

(52) U.S. Cl.
CPC ..... *H04R 25/00* (2013.01); *H04R 1/2892* (2013.01); *H04R 25/453* (2013.01); *H04R 25/456* (2013.01); *H04R 25/602* (2013.01)

(58) Field of Classification Search
CPC .... H04R 25/00; H04R 25/652; H04R 19/005; H04R 19/01; H01L 14/00
USPC ..... 381/23.1, 312; 600/25
See application file for complete search history.

(56) References Cited

U.S. PATENT DOCUMENTS 6,549,634 B1 * 4/2003 Vonlanthen ..... H04R 25/604 381/322
2011/0144415 A1 * 6/2011 Hellmuth ..... H04R 25/606 600/25

FOREIGN PATENT DOCUMENTS

DE 102009010603 A1 5/2010
DE 102010014315 A1 10/2011
DE 102011013895 A1 9/2012

* cited by examiner

*Primary Examiner* — Sunita Joshi
(74) *Attorney, Agent, or Firm* — Birch, Stewart, Kolasch & Birch, LLP

(57) ABSTRACT

A hearing aid device comprising means for being at least partly inserted into the ear canal of a hearing aid user is disclosed. The hearing aid device comprises at least one electro-active member comprising a top electrode layer and a bottom electrode layer and a dielectric elastomer member sandwiched between the top electrode layer and the bottom electrode layer.

31 Claims, 7 Drawing Sheets

80
52
76
2
28
74'
74
72
70'
70
48
68
68'
62
68''
68'''
60
42
58
56
54
78
52
76
76''
76'
66
64
50

HEARING AID DEVICE

FIELD

The present disclosure generally relates to a hearing aid device. The present disclosure more particularly relates to a hearing aid device that is easy to use, comfortable to wear and is configured to improve the hearing capability of the user.

DESCRIPTION OF RELATED ART

In the field of hearing aid devices, the use of actuators has already been introduced. Actuators are used in various setups typically with the purpose of solving tasks of mechanical character. The actuators used in the prior art hearing aid devices are, however, expensive and rather complex and thus requires advanced regulation means and a considerable amount of space.

As all hearing aid manufactures aim for providing hearing aid devices capable of meeting the wearer's individual requirements, there is a need for an improved hearing aid device that reduces or even eliminates these drawbacks of the prior art.

The present disclosure provides an improved hearing aid device that is less expensive to produce and requires less regulation means and/or space than the prior art hearing aid devices.

SUMMARY

The invention can be achieved by a hearing aid device as defined in claim 1. Preferred embodiments are defined in the dependent sub claims and explained in the following description and illustrated in the accompanying drawings.

The hearing aid according to an embodiment of the disclosure is a hearing aid device comprising a means for being at least partly inserted into the ear canal of a hearing aid user, where the hearing aid device comprises at least one electro-active member comprising a top electrode layer, a bottom electrode layer and a dielectric elastomer member sandwiched between the top electrode layer and the bottom electrode layer.

Hereby it is possible to provide an improved hearing aid device that is less expensive to produce and requires less regulation means and/or space than the prior art hearing aid devices that comprise actuators.

The hearing aid according to the disclosure is a hearing aid device comprising means for being at least partly inserted into the ear canal of a hearing aid user. The hearing aid device may be of any suitable type such as a behind-the-ear (BTE) hearing aid device, in-the-ear (ITE) haring aid device, receiver-in-the-ear (RITE) device, invisible-in-canal (IIC) hearing aid device, completely-in-canal (CIC) hearing aid device, or a bone anchored hearing aid (BAHA).

The hearing aid device comprises at least one electro-active member comprising a top electrode layer and a bottom electrode layer and a dielectric elastomer member sandwiched between the top electrode layer and the bottom electrode layer.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

The "hearing aid device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

The hearing device may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc.

The hearing device may comprise a single unit or several units communicating electronically with each other.

More generally, the hearing aid device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal.

Some hearing aid devices may comprise multiple input transducers, e.g. for providing direction-dependent audio signal processing. In some hearing aid devices, the receiver may be a wireless receiver. In some hearing aid devices, the receiver may be e.g. an input amplifier for receiving a wired signal. In some hearing aid devices, an amplifier may constitute the signal processing circuit.

In some hearing aid devices, the output means may comprise an output transducer, such as e.g. a loudspeaker for providing an air-borne acoustic signal or a vibrator for providing a structure-borne or liquid-borne acoustic signal.

In some hearing aid devices, the output means may comprise one or more output electrodes for providing electric signals.

In some hearing aid devices, the vibrator may be adapted to provide a structure-borne acoustic signal transcutaneously or percutaneously to the skull bone. In some hearing aid devices, the vibrator may be implanted in the middle ear and/or in the inner ear. In some hearing aid devices, the vibrator may be adapted to provide a structure-borne acoustic signal to a middle-ear bone and/or to the cochlea.

In some hearing aid devices, the vibrator may be adapted to provide a liquid-borne acoustic signal in the cochlear liquid, e.g. through the oval window.

In some hearing aid devices, the output electrodes may be implanted in the cochlea or on the inside of the skull bone and may be adapted to provide the electric signals to the hair cells of the cochlea, to one or more hearing nerves and/or to the auditory cortex.

In the present context, one or more hearing aid devices may constitute a "hearing system". The hearing aid device may be a "binaural hearing system" referring to a system comprising one or two hearing aid devices adapted to cooperatively provide audible signals to both of the user's ears.

Hearing systems or binaural hearing systems may further comprise "auxiliary devices", which communicate with the hearing aid devices and affect and/or benefit from the function of the hearing aid devices.

Auxiliary devices may be e.g. remote controls, remote microphones, audio gateway devices, mobile phones, public-address systems, car audio systems or music players.

Hearing aid devices, hearing systems or binaural hearing systems may e.g. be used for compensating for a hearing-impaired person's loss of hearing capability, augmenting or protecting a normal-hearing person's hearing capability and/or conveying electronic audio signals to a person.

It may be useful that the hearing aid device comprises an ear mould and that at least one electro-active member is provided at the ear mould.

Hereby it is possible to provide an ear mould that the hearing aid user can feel, e.g. when a sound above a predefined sound level is generated by the hearing aid device.

It may be useful that the hearing aid device comprises means for activating the electro-active member (an actuator) in any other desired manner, e.g. depending on the sound level detected by the microphone(s) of the hearing aid device.

It may be beneficial that the ear mould comprises a tube and an electrical wire that electrically connects the hearing aid body and an actuator provided at the surface of the ear mould. The electro-active member (an actuator) may comprise means for changing its shape in a predefined way when predefined criterions are met.

It may be useful that the hearing aid device comprises a hearing aid body and that at least one electro-active member provided at the hearing aid body.

Hereby it is possible to use the at least one electro-active member directly on the hearing aid body. The electro-active member may be provided on the outside surface of the hearing aid body.

It may be beneficial that the hearing aid device comprises a vent and a vent member comprising at least one electro-active member.

Hereby it is possible to provide a reliable vent mechanism. The vent member may function as a valve that is capable of opening and closing a through-going vent extending through the hearing aid body of a hearing aid device.

It may be useful that the hearing aid device comprises an artificial ear drum provided at the ear drum of a hearing aid user or comprising means for being attached to the ear drum of a hearing aid user or provided at the distal end of the hearing aid device, where the artificial ear drum comprising at least one electro-active member.

Hereby it is possible to compensate for a malfunctioning ear drum.

It may be useful that the hearing aid device comprises a control member provided with at least one electro-active member.

Hereby it is possible to give the hearing aid user feedback when operating the at least one control member.

It may be beneficial that the hearing aid device comprises a microphone inlet that is movably mounted by means of at least one electro-active member.

Hereby it is possible to move and/or vibrate the microphone in any desired way e.g. as response of one or more detected signals.

It may be useful that the hearing aid device comprises means for detecting the orientation of the microphone inlet (e.g. relative to horizontal) and means for changing the orientation of the microphone inlet.

Hereby it is possible to adjust the orientation of the microphone inlet e.g. in order to carry out directional optimization.

It may be useful that the hearing aid device comprises a microphone that is mechanically attached to at least one transducer vibrator comprising at least one electro-active member.

In this way it is possible to vibrate the microphone in a simple and easy manner.

It may be beneficial that the microphone that is mechanically attached to a plurality of transducer vibrators and that the hearing aid device comprises means for providing motion of the transducer vibrators.

Hereby it is possible to provide a multidimensional motion of the microphone e.g. to create a complex movement pattern in order to reduce vibration effects (e.g. vibro-acoustic feedback).

It may be useful that the hearing aid device comprises a receiver that is mechanically attached to at least one transducer vibrator comprising at least one electro-active member.

Hereby, it is possible to vibrate the receiver in a simple and easy manner.

It may be useful that the receiver that is mechanically attached to a plurality of transducer vibrators and that the hearing aid device comprises means for providing motion of the transducer vibrators.

Hereby it is possible to provide a multidimensional motion of the receiver e.g. to create a complex movement pattern in order to reduce vibration effects (e.g. vibro-acoustic feedback).

It may be beneficial that the microphone and/or the receiver is mechanically attached to a plurality of transducer vibrators and that the hearing aid device comprises means for creating a counter vibrating frequency to cancel out the frequency of the microphone(s) and/or the receiver.

Hereby it is possible to eliminate vibro-acoustic feedback within the hearing aid device.

It may be useful that the hearing aid device comprises a hearing aid body comprising one or more actuators capable of pressing against a battery (upon electrical activation) and hereby firmly fixing the battery to a battery compartment of the hearing aid body.

Hereby a firm attachment of a battery can be achieved by simple means.

It may be beneficial that the hearing aid device comprises a button provided with a haptic layer comprising an electro-active member.

Hereby it is possible to provide tactile feedback through change of the configuration of the "haptic layer". It is possible to move the "haptic layer" when the hearing aid user is touching the button. In this manner it is possible to create a haptic hearing aid in the user experiences contact and force-feedback when operating the button so that the user "feels" when control devices of the hearing aid device are operated.

The "haptic layer" may comprise an electro-active member comprising a number of sensor units configured to detect when the button is activated and detect the force applied when operating the button. In this way the hearing aid device may be configured to give a complex feedback depending on the force applied on the button.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 1 B) shows a schematic side view of an electro-active member in a first configuration according to an embodiment of the disclosure;

FIG. 1 C) shows a schematic side view of an electro-active member in a second configuration according to an embodiment of the disclosure;

FIG. 2 B) shows a hearing aid user wearing a hearing aid device according to an embodiment of the disclosure;

FIG. 2 C) shows a close-up view of an ear mould hearing shown in FIG. 2 B) according to an embodiment of the disclosure;

FIG. 3 B) shows a schematic view of a hearing aid device provided with an artificial ear drum according to an embodiment of the disclosure;

FIG. 4 B) shows a close-up view of the hearing aid shown in FIG. 4 a) according to an embodiment of the disclosure;

FIG. 5 B) shows a first close-up view of the hearing aid device shown in FIG. 5 A) according to an embodiment of the disclosure;

FIG. 5 C) shows a second close-up view of the hearing aid device shown in FIG. 5 A) according to an embodiment of the disclosure;

FIG. 6 B) shows a schematic perspective view of another hearing aid device according to an embodiment of the disclosure;

FIG. 6 C) shows a close-up view of the hearing aid device shown in FIG. 6 A) and FIG. 6 B) according to an embodiment of the disclosure;

FIG. 7 B) shows a close-up view of a battery compartment of the hearing aid shown in FIG. 7 A) according to an embodiment of the disclosure; and FIG. 7 C) shows a close-up view of the battery compartment shown in FIG. 7 B) in another configuration according to an embodiment of the disclosure.

DETAILED DESCRIPTION

Figure 1:
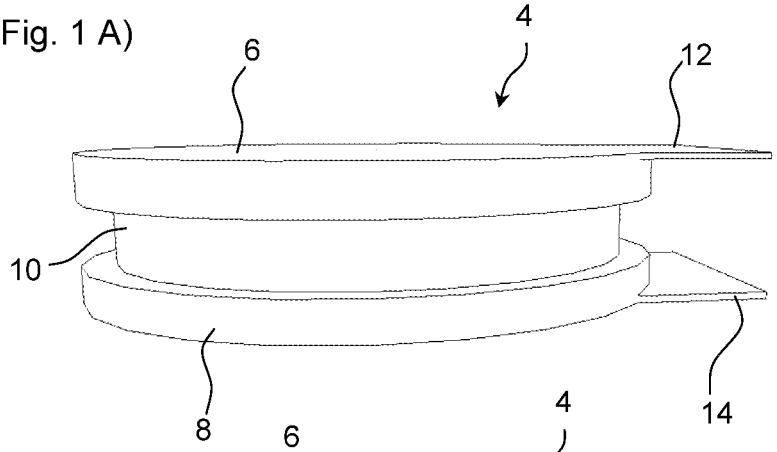
FIG. 1 A) shows a schematic perspective view of an electro-active member according to an embodiment of the disclosure.
Figure 1:
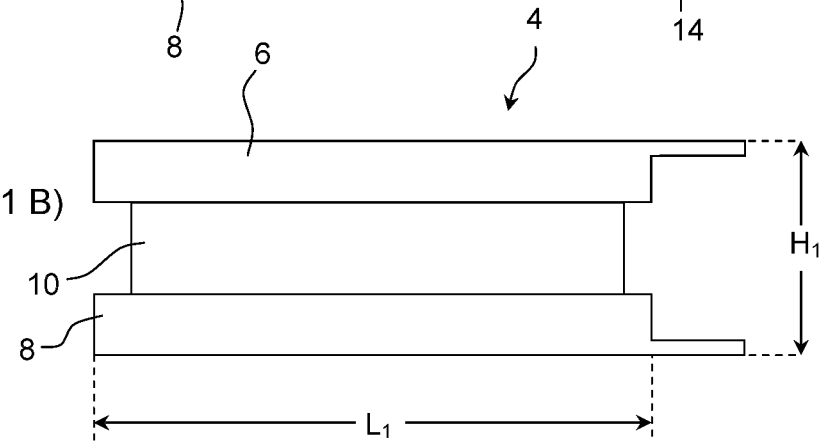
Figure 1:
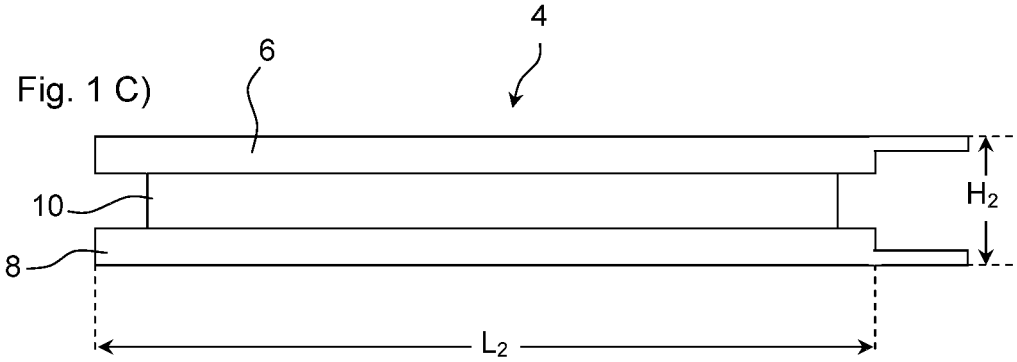

Referring now in detail to the drawings for the purpose of illustrating preferred embodiments of the present disclosure, different views of an electro-active member 4 according to the disclosure is illustrated in FIG. 1.

FIG. 1 A) illustrates a schematic perspective view of an electro-active member 4 according to an embodiment of the disclosure. The electro-active member 4 comprises a plate-shaped top electrode layer 6 having a circular cross-section. A plate-shaped electrical connection member 12 protrudes from the top electrode layer 6 and is electrically connected to the top electrode layer 6.

The electro-active member 4 comprises a plate-shaped bottom electrode layer 8 having a circular cross-section. A plate-shaped electrical connection member 14 protrudes parallel or substantially parallel to the electrical connection member 12 from the top electrode layer 6, which is electrically connected to the top electrode layer 6.

A dielectric elastomer member (film) 10 is centrally arranged and sandwiched between the top electrode layer 6 and the bottom electrode layer 8.

FIG. 1 B) illustrates a schematic side view of the electro-active member 4 shown in FIG. 1 A) in a first configuration in which the height (thickness) $H_1$ of the dielectric elastomer member 10, the top electrode layer 6 and the bottom electrode layer 8 is large, and in which configuration the width $L_1$ of the top electrode layer 6 and the bottom electrode layer 8 is small.

FIG. 1 C) illustrates a schematic side view of the electro-active member 4 shown in FIG. 1 A) and FIG. 1 B) in a second configuration in which the height (thickness) $H_2$ of the dielectric elastomer member 10, the top electrode layer 6 and the bottom electrode layer 8 is significantly smaller than in FIG. 1 B) and in which configuration the width $L_2$ of the top electrode layer 6 and the bottom electrode layer 8 is significantly larger than in FIG. 1 B).

When voltage is applied across the electrodes 6, 8; the electrodes 6, 8 attract each other and the dielectric elastomer member 10 contracts in thickness and expands in area.

Accordingly, when voltage is applied across the electrodes 6, 8 it is possible to use the electro-active member 4 as an actuator capable of converting the expansion of the dielectric elastomer member into motion in a desired direction.

It would be possible to apply several electro-active members 4 connected or used together in order to generate a more complex motion.

Figure 2:
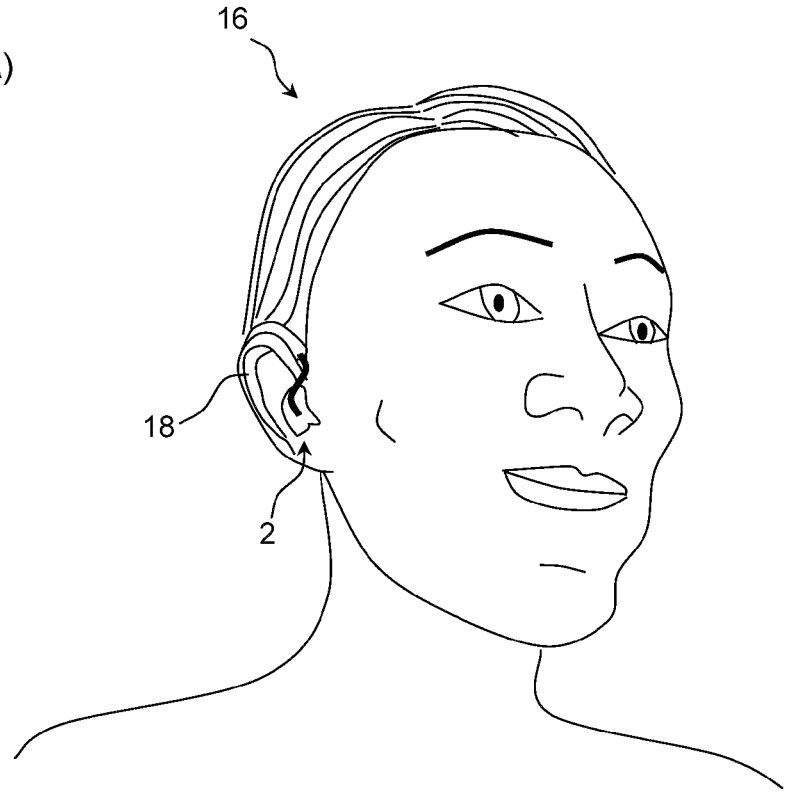
FIG. 2 A) shows a hearing aid user wearing a hearing aid device according to an embodiment of the disclosure.
Figure 2:
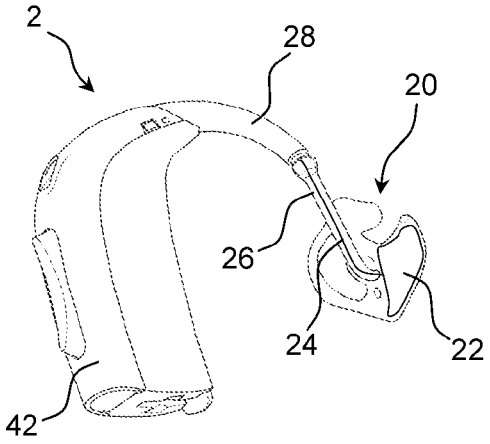
Figure 2:
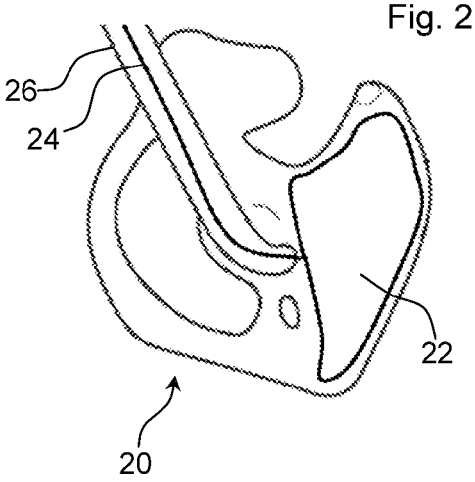

FIG. 2 A) illustrates a hearing aid user 16 wearing a hearing aid device 2 according to an embodiment of the disclosure. The hearing aid device 2 is a BTE hearing aid device 2 with an ear mould inserted into the ear 18.

FIG. 2 B) illustrates a schematic perspective view of a hearing aid device 2 according to an embodiment of the disclosure. The hearing aid device 2 is a BTE hearing aid device 2 comprising a hearing aid body 42, a sound hook 28 mechanically attached at a distal end of the hearing aid body 42 and an ear mould 20 mechanically attached at the distal end of the sound hook 28 using a tube 26 and a wire 24.

The ear mould 20 comprises at least a part of the tube 26 and the wire 24. The wire 24 offers electrical conduction and connects the hearing aid body 42 and an actuator 22 provided at the surface of the ear mould 20. The actuator 22 comprises an electro-active member 4 as described with reference to FIG. 1. The actuator 22 is capable of changing its shape in a predefined way when predefined criterions are met.

In this way, it is possible to let the hearing aid user "feel" when a sound above a predefined sound level is generated by the hearing aid device 2. It is also possible to activate the actuator in any other desired manner. By way of example, it is possible to let the force with which the actuator 22 presses against the ear 18 (or ear canal), of the hearing aid user 16, depend on the sound level detected by the microphone(s) of the hearing aid device 2.

In this way, the hearing aid user 16 is capable of "feeling the sound". The ear mould 20 may comprise several actuators 22 (e.g. actuators 22 applying force in different directions).

FIG. 2 C) illustrates a close-up view of the ear mould 20 shown in FIG. 2 B).

Figure 3:
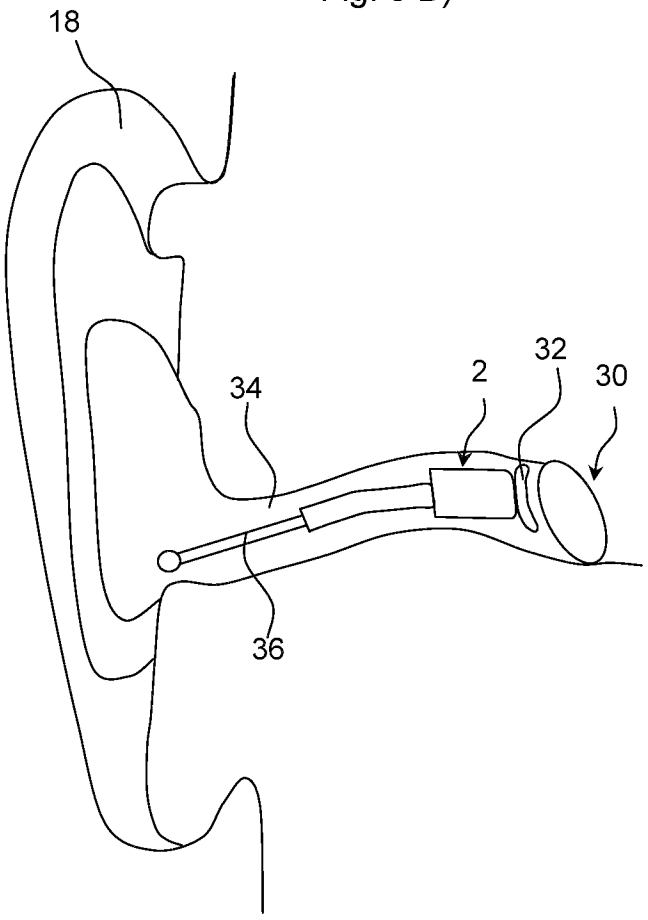
FIG. 3 A) shows a schematic view of an artificial ear drum according to an embodiment of the disclosure.
Figure 3:
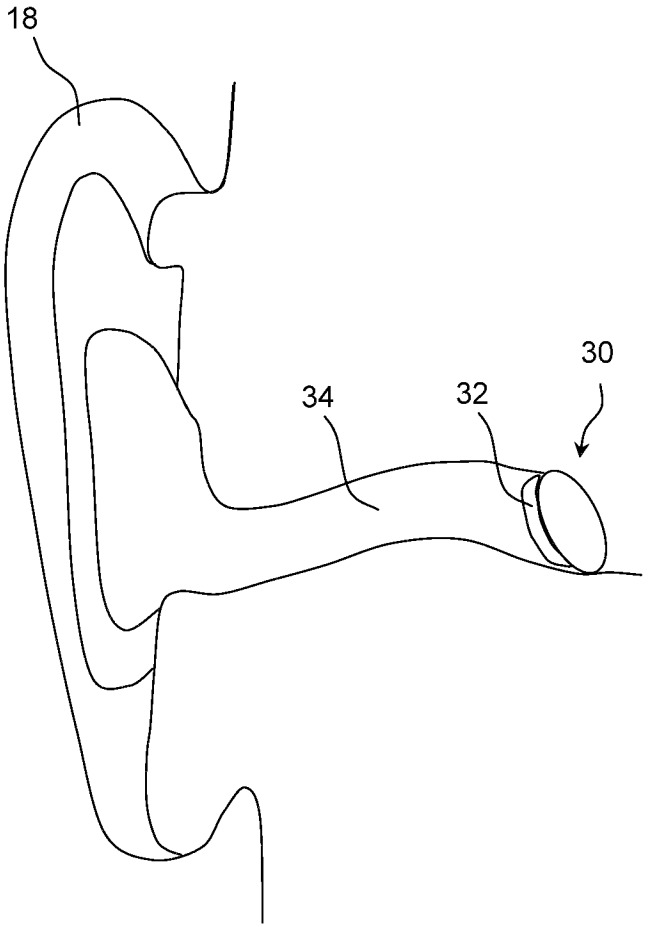

FIG. 3 A) illustrates a schematic view of an ear 18 of a hearing aid user applying a hearing aid device according to the disclosure. An artificial ear drum 32 has been inserted through the ear canal 34 and attached to the ear drum 30. The hearing aid device may comprise a portion that is electrically connected to the artificial ear drum 32 and that is capable of activating the artificial ear drum 32 in order to generate a desired sound experience for the hearing aid user.

FIG. 3 B) schematically illustrates a view of a hearing aid device 2 according to the disclosure arranged in the ear canal 34 of a hearing aid user. The hearing aid device 2 is an ITE hearing aide device comprising a pull-out string 36. The artificial ear drum 32 is attached at the distal end of the hearing aid device 2. The artificial ear drum 32 comprises an electro-active member 4 as described with reference to FIG. 1. The electro-active member 4 is electrically driven and thus it is possible to generate any desired vibrations and thus sound output.

Figure 4:
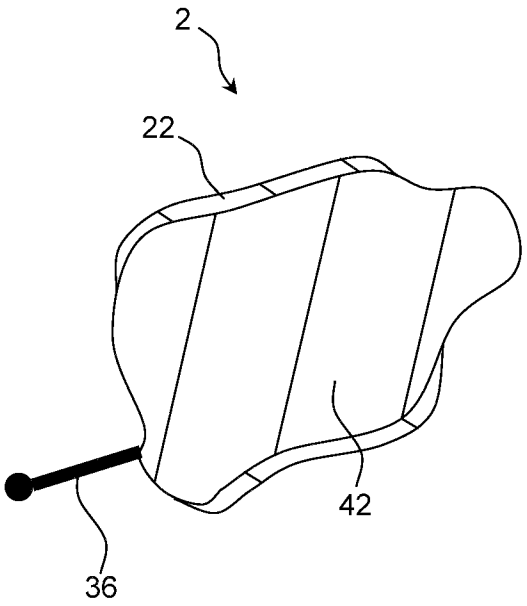
FIG. 4 A) shows a schematic view of a hearing aid device arranged in the ear canal of a hearing aid user according to an embodiment of the disclosure.
Figure 4:
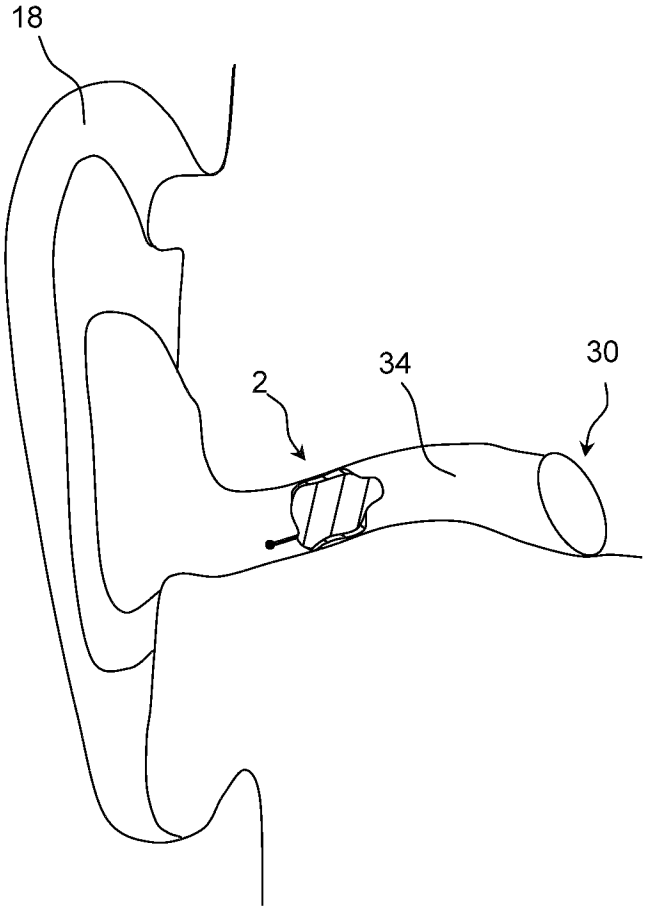

FIG. 4 A) illustrates schematically cross-sectional views of the ear 18 and a hearing aid device 2 according to an embodiment of the disclosure. The hearing aid device 2 is a CIC hearing aid device arranged in the ear canal 34 of the hearing aid user in a distance from the ear drum 30.

FIG. 4 B) illustrates schematically close-up view of the hearing aid device 2 shown in FIG. 4 A). The hearing aid device 2 comprises a hearing aid body 42, a pull-out string 36 and an actuator 22 provided at the outside surface of the hearing aid body 42.

The actuator 22 may be applied to provide an optimum fit within the ear canal 34. The thickness of the actuator 22 may be changed according to specific requirements e.g. on the basis of measurements.

In one embodiment of the disclosure, the hearing aid device 2 may comprise sensor members (not shown) configured to monitor the pressure on the actuator 22 and means for activating the actuator 22 in such a manner that the pressure is within a predefined interval. Accordingly, it would be possible to alter the thickness of the actuator 22 in order to make an optimal fit between the hearing aid device 2 and the ear canal 34.

The hearing aid device 2 may comprise means for controlling the actuator 22 by using the pull-out string 36.

Figure 5:
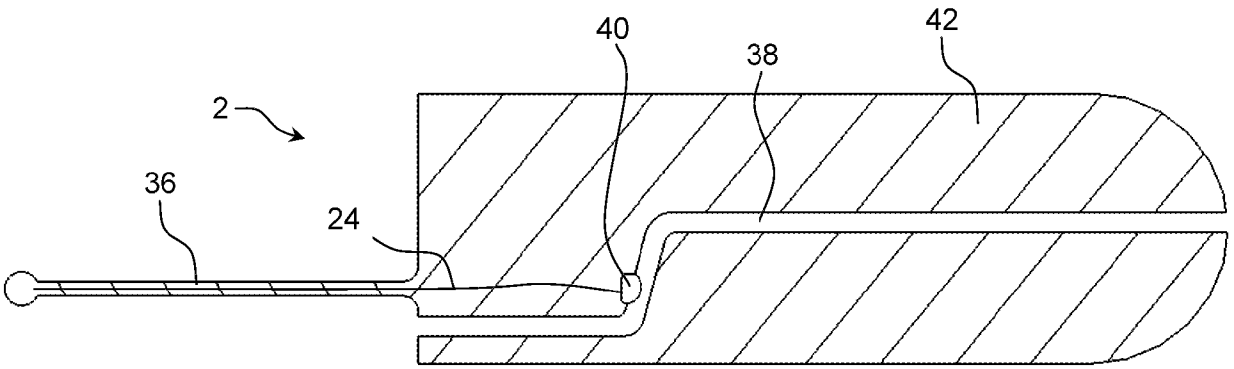
FIG. 5 A) shows a schematic cross-sectional view of a hearing aid according to an embodiment of the disclosure.
Figure 5:
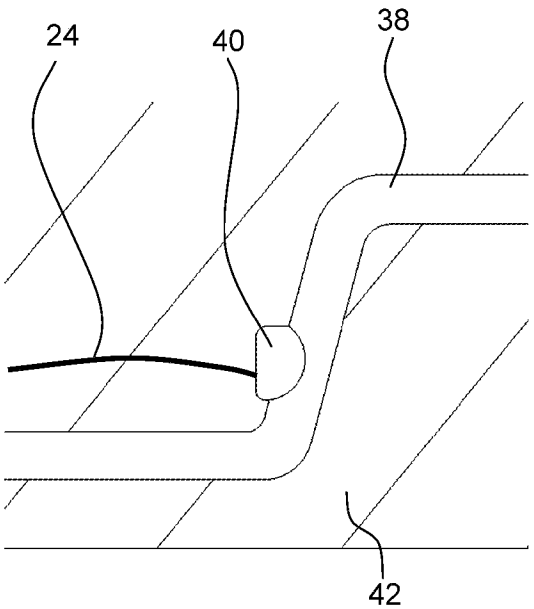
Figure 5:
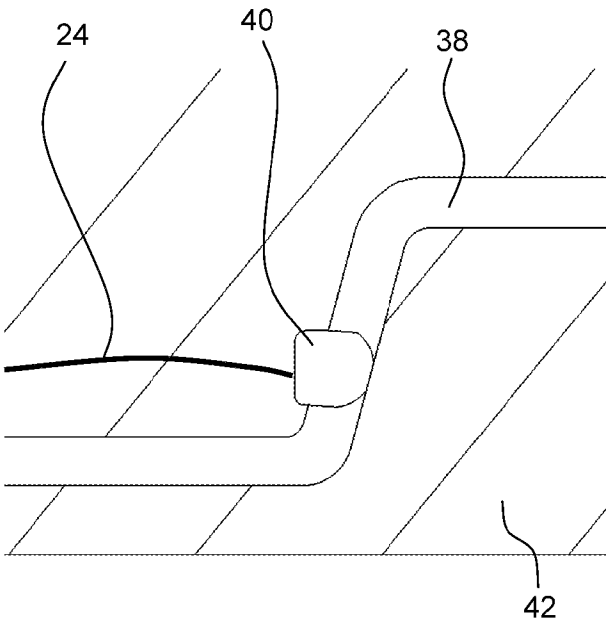

FIG. 5 A) illustrates a schematically cross-sectional view of a hearing aid device 2 according to an embodiment of the disclosure. The hearing aid device 2 comprises a hearing aid body 42 and a pull out string 36 protruding from the end surface of the hearing aid device 2. A vent 38 is provided within the hearing aid body 42. A vent member 40 comprising an electro-active member according to the disclosure is provided in the vent 38.

The vent member 40 comprises means for expanding upon electrical activation. Thus, the vent member 40 is configured to act as a valve member capable of opening and closing the vent 38. The vent member 40 is configured to provide any desired degree of ventilation by varying the size of the opening area. An electrically conducting wire 24 is provided within the pull out string 36. The hearing aid device 2 may comprise means for controlling the actuator 22 by using the pull-out string 36. The wire 24 is connected to the vent member 40 and hereby is suited for providing a voltage across the electrodes of the vent member 40. Hereby, the vent member 40 can contract in thickness and expands in area or expand in thickness and decrease in area depending on the electrical activation.

FIG. 5 B) illustrates a close-up view of the vent member 40 in a configuration in which the vent member 40 allows ventilation through the vent 38. The vent member 40 is not fully expanded in thickness and thus air is allowed to pass through the vent 38.

FIG. 5 C) illustrates a close-up view of the vent member 40 in a configuration in which the vent member 40 blocks the vent 38 so that no ventilation can be achieved through the vent 38. The vent member 40 is fully expanded in thickness and no air is allowed to pass through the vent 38.

It is possible to gradually regulate the thickness of the vent member 40 and hereby provide any desired degree of ventilation. Hereby, an easy and reliable vent mechanism can be achieved.

Figure 6:
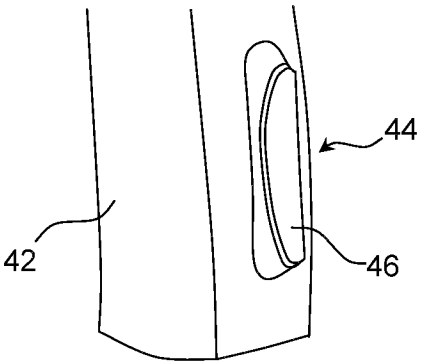
FIG. 6 A) shows a schematic perspective view of a hearing aid device according to an embodiment of the disclosure.
Figure 6:
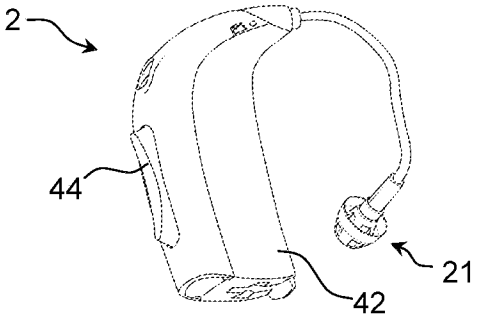
Figure 6:
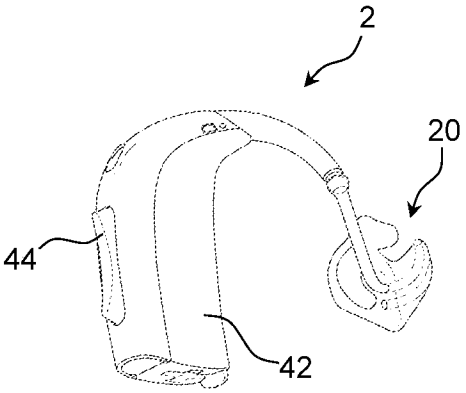

FIG. 6 A) illustrates a schematic cross-sectional view of a hearing aid device 2 according to an embodiment of the disclosure. The hearing aid device 2 is a BTE hearing aid 2 comprising a hearing aid body 42, an ear mould 20 and a volume button 44.

FIG. 6 B) illustrates a schematic cross-sectional view of another hearing aid device 2 according to an embodiment of the disclosure. The hearing aid device 2 comprises a hearing aid body 42, a receiver 21 onto which a dome is attached and a volume button 44.

FIG. 6 C) illustrates a close-up view of the volume button 44 illustrated in FIG. 6 A) and FIG. 6 B). The volume button 44 comprises a "haptic layer" 46 that is configured to provide tactile feedback through change of the configuration of the "haptic layer" 46. It is possible to move the "haptic layer" 46 when the hearing aid user is touching the volume button 44. Hereby it is possible to create a haptic hearing aid device in the user experiences contact and force-feedback when operating the volume button so that the user "feels" when control devices of the hearing aid device are operated.

The "haptic layer" 46 comprises an electro-active member like the one explained with reference to FIG. 1. The"haptic layer" 46 may comprise a number of sensor units configured to detect when the volume button is activated and detect the force applied when operating the volume button.

Accordingly, the hearing aid 2 may be configured to give a complex feedback depending on the force applied on the volume button.

Figure 7:
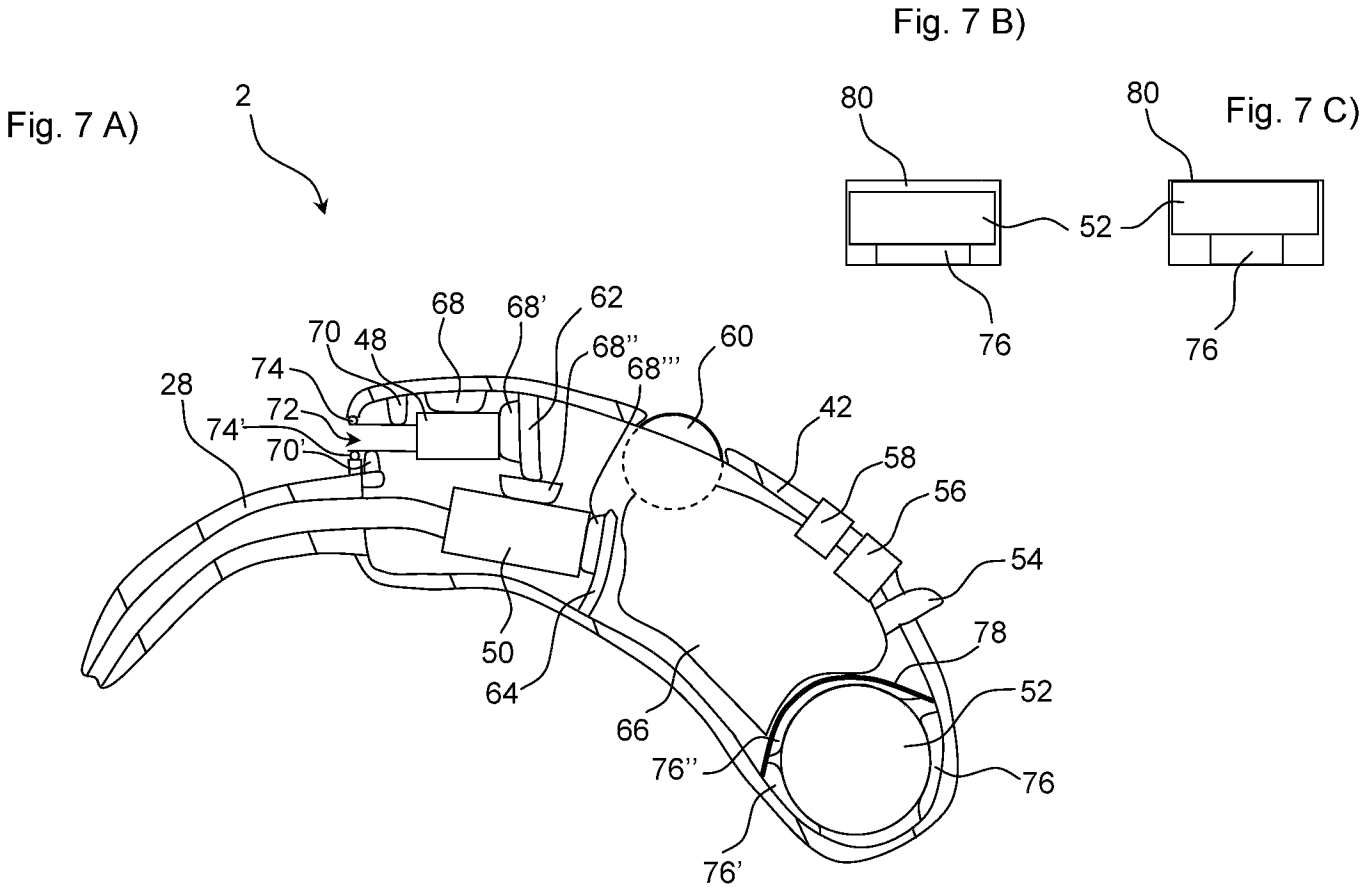
FIG. 7 A) shows a schematic cross-sectional view of a hearing aid device according to an embodiment of the disclosure.

FIG. 7 A) illustrates a schematic cross-sectional view of a hearing aid device 2 according to an embodiment of the disclosure. The hearing aid device 2 is a BTE hearing aid device 2 comprising a hearing aid body 42, a sound hook 28 and a number of elements housed within the hearing aid body 42.

The hearing aid body 42 comprises a receiver 50 and a microphone 48. The receiver 50 is movably mounted by means of a first transducer vibrator 68" and a second transducer vibrator 68'" attached to a first support member 62 and to a second support member 64, respectively. The microphone 48 is movably mounted by means of a first transducer vibrator 68 and a second transducer vibrator 68' attached to a first support member 62.

Each of the transducer vibrators 68, 68', 68", 68'" comprises a electro-active member and means for providing motion of the transducers (the microphone 48 and the receiver 50). Hereby, it is possible to vibrate the microphone 48 and the receiver 50 and hereby create a counter vibrating frequency to cancel out the frequency of the microphone 48 and the receiver 50, respectively. Accordingly, it is possible to eliminate the vibro-acoustic feedback in the hearing aid 2.

The hearing aid device 2 comprises an inlet 72 that is movably mounted to the hearing aid body 42. The inlet may be sealed by using seals 74, 74'. The inlet 72 comprises a generally tube-shaped inlet member that is mechanically attached to a first actuator 70 and to a second actuator 70' attached to the hearing aid body 42 of the hearing aid device 2. The actuators 70, 70' comprise electro-active members of the type explained with reference to FIG. 1.

Accordingly, the microphone inlet 72 is suitable for mechanically changing the orientation of the microphone inlet 72 e.g. relative to horizontal in order to ensure that the microphone inlet 72 is horizontally arranged when used for directional optimization of the hearing aid device 2.

The hearing aid body 42 comprises a battery 52 that is held in place by a first actuator 76, a second actuator 76' and a third actuator 76"attached to the hearing aid body 42 and to a support member 78. These actuators 76, 76', 76" are configured to provide a 'tight fit' fixation of the battery 52. The actuators 76, 76', 76"comprise electro-active members of the type explained with reference to FIG. 1.

The hearing aid body 42 comprises volume control button 60, a first control button 56, and a second control button 58 electrically connected to the amplifier 66 of the hearing aid device 2. The hearing device may also include a control member such as a switch 54.

FIG. 7 B) and FIG. 7 C) illustrate two schematic side views of a portion of a hearing aid device according to the disclosure. A battery 52 is arranged within a battery compartment 80 of the hearing aid device. An actuator 76 comprising an electro-active member is arranged under the battery 52.

In FIG. 7 B) the actuator 76 has not been fully extended and thus there is a gap between the top side of the battery 52 and the top portion of the battery compartment 80.

In FIG. 7 C) the actuator 76 has been fully extended. Accordingly, there is no gap between the top side of the battery 52 and the top portion of the battery compartment 80. Thus, the top side of the battery 52 bears against the top portion of the battery compartment 80.

It should be appreciated that reference throughout this specification to "one embodiment" or "an embodiment" or features included as "may" or "can" means that a particular feature, structure or characteristic described in connection with the embodiment is included in at least one embodiment of the disclosure. Therefore, it is emphasized and should be appreciated that two or more references to "an embodiment" or "one embodiment" or "an alternative embodiment" or features included as "may"/"can" in various portions of this specification are not necessarily all referring to the same embodiment. Furthermore, the particular features, structures or characteristics may be combined as suitable in one or more embodiments of the disclosure.

Throughout the foregoing description, for the purposes of explanation, numerous specific details were set forth in order to provide a thorough understanding of the disclosure.

Accordingly, the scope should be judged in terms of the claims which follow.

LIST OF REFERENCE NUMERALS

2 Hearing aid device
4 Electro-active member
6 Top electrode layer
8 Bottom electrode layer
10 Dielectric elastomer member
12, 14 electrical connection member
16 Hearing aid user
18 Ear
20 Ear mould
21 Receiver
22 Actuator
24 Wire
26 Tube
28 Sound hook
30 Ear drum
32 Artificial ear drum
34 Ear canal
36 Pull-out string
38 Vent
40 Vent member
42 Hearing aid body
44 Button
$H_1$, $H_2$ Height
$L_1$, $L_2$ Width
46 Haptic layer
48 Microphone
50 Receiver
52 Battery
54 Switch
56, 58 Button
60 Volume control
62, 64 Support member
66 Amplifier
68, 68', 68", 68'" Transducer vibrator
70, 70' Actuator
72 Inlet
74, 74' Sealing
76, 76', 76"Actuator
78 Support member
80 Battery compartment

The invention claimed is:

1. A hearing aid device configured for being at least partly inserted into the ear canal of a hearing aid user, wherein the hearing aid device comprises at least one electro-active member comprising a top electrode layer, a bottom electrode layer and a dielectric elastomer member sandwiched between the top electrode layer and the bottom electrode layer, wherein the hearing aid device further comprises an artificial ear drum provided at the ear drum of a hearing aid user, the artificial ear drum being configured for attachment to the ear drum of a hearing aid user or the artificial ear drum being provided at the distal end of the hearing aid device, the artificial ear drum comprising at least one electro-active member.

2. The hearing aid device according to claim 1, wherein the hearing aid device further comprises an ear mould comprising at least one electro-active member.

3. The hearing aid device according to claim 1, wherein the hearing aid device further comprises a vent and a vent member comprising at least one electro-active member.

4. A hearing aid device configured for being at least partly inserted into the ear canal of a hearing aid user, wherein the hearing aid device comprises at least one electro-active member comprising a top electrode layer, a bottom electrode layer and a dielectric elastomer member sandwiched between the top electrode layer and the bottom electrode layer, wherein the hearing aid device further comprises a microphone and a microphone inlet configured to receive an acoustic signal from the hearing aid user's surroundings and to provide a passageway for the acoustic signal from the hearing aid user's surroundings to the microphone, wherein the microphone inlet is movably mounted by means of at least one electro-active member, so that orientation of the microphone inlet changes relative to the microphone.

5. The hearing aid device according to claim 4, wherein the hearing aid device further comprises means for detecting the orientation of the microphone inlet and means for changing the orientation of the microphone inlet.

6. A hearing aid device configured for being at least partly inserted into the ear canal of a hearing aid user, wherein the hearing aid device comprises at least one electro-active member comprising a top electrode layer, a bottom electrode layer and a dielectric elastomer member sandwiched between the top electrode layer and the bottom electrode layer , wherein the hearing aid device further comprises a microphone that is mechanically attached to at least one transducer vibrator comprising at least one electro-active member, and the at least one transducer vibrator is configured to provide a multi-dimensional motion of the microphone.

7. The hearing aid device according to claim 6, wherein the microphone is mechanically attached to a plurality of transducer vibrators and the hearing aid device comprises means for providing motion of the transducer vibrators.

8. The hearing aid device according to claim 1, wherein the hearing aid device further comprises a receiver that is mechanically attached to at least one transducer vibrator comprising at least one electro-active member.

9. The hearing aid device according to claim 6, wherein the hearing aid device further comprises a receiver, and the microphone and/or the receiver is mechanically attached to a plurality of transducer vibrators and that the hearing aid device comprises means for creating a counter vibrating frequency to cancel out the frequency of the microphone and/or the receiver.

10. The hearing aid device according to claim 1, wherein the hearing aid device further comprises a hearing aid body comprising one or more actuators capable of pressing against a battery and thereby firmly fixing the battery to a battery compartment of the hearing aid body.

11. The hearing aid device according to claim 2, wherein the hearing aid device comprises a microphone that is mechanically attached to at least one transducer vibrator comprising at least one electro-active member.

12. The hearing aid device according to claim 3, wherein the hearing aid device comprises a microphone that is mechanically attached to at least one transducer vibrator comprising at least one electro-active member.

13. The hearing aid device according to claim 1, wherein the hearing aid device comprises a microphone that is mechanically attached to at least one transducer vibrator comprising at least one electro-active member.

14. A hearing aid device configured for being at least partly inserted into the ear canal of a hearing aid user, wherein the hearing aid device comprises at least one electro-active member comprising a top electrode layer, a bottom electrode layer and a dielectric elastomer member sandwiched between the top electrode layer and the bottom electrode layer, wherein the hearing aid device further comprises a microphone that is mechanically attached to at least one transducer vibrator comprising at least one electro-active member, the hearing aid device further comprises a hearing aid body, and the at least one transducer vibrator is attached to an inner surface of a housing of the hearing aid body.

15. A hearing aid device configured for being at least partly inserted into the ear canal of a hearing aid user, wherein the hearing aid device comprises at least one electro-active member comprising a top electrode layer, a bottom electrode layer and a dielectric elastomer member sandwiched between the top electrode layer and the bottom electrode layer, wherein the hearing aid device further comprises a microphone and a receiver, the microphone and/or the receiver is mechanically attached to a plurality of transducer vibrators, and the hearing aid device further comprises means for creating a counter vibrating frequency to cancel out the frequency of the microphone and/or the receiver.

16. The hearing aid device according to claim 4, wherein the hearing aid device further comprises an ear mould comprising at least one electro-active member.

17. The hearing aid device according to claim 6, wherein the hearing aid device further comprises an ear mould comprising at least one electro-active member.

18. The hearing aid device according to claim 14, wherein the hearing aid device further comprises an ear mould comprising at least one electro-active member.

19. The hearing aid device according to claim 15, wherein the hearing aid device further comprises an ear mould comprising at least one electro-active member.

20. The hearing aid device according to claim 4, wherein the hearing aid device further comprises a vent and a vent member comprising at least one electro-active member.

21. The hearing aid device according to claim 6, wherein the hearing aid device further comprises a vent and a vent member comprising at least one electro-active member.

22. The hearing aid device according to claim 14, wherein the hearing aid device further comprises a vent and a vent member comprising at least one electro-active member.

23. The hearing aid device according to claim 15, wherein the hearing aid device further comprises a vent and a vent member comprising at least one electro-active member.

24. The hearing aid device according to claim 4, wherein the hearing aid device further comprises a receiver that is mechanically attached to at least one transducer vibrator comprising at least one electro-active member.

25. The hearing aid device according to claim 6, wherein the hearing aid device further comprises a receiver that is mechanically attached to at least one transducer vibrator comprising at least one electro-active member.

26. The hearing aid device according to claim 14, wherein the hearing aid device further comprises a receiver that is mechanically attached to at least one transducer vibrator comprising at least one electro-active member.

27. The hearing aid device according to claim 15, wherein the hearing aid device further comprises a receiver that is mechanically attached to at least one transducer vibrator comprising at least one electro-active member.

28. The hearing aid device according to claim 4, wherein the hearing aid device further comprises a hearing aid body comprising one or more actuators capable of pressing against a battery and thereby firmly fixing the battery to a battery compartment of the hearing aid body.

29. The hearing aid device according to claim 6, wherein the hearing aid device further comprises a hearing aid body comprising one or more actuators capable of pressing against a battery and thereby firmly fixing the battery to a battery compartment of the hearing aid body.

30. The hearing aid device according to claim 14, wherein the hearing aid device further comprises a hearing aid body comprising one or more actuators capable of pressing against a battery and thereby firmly fixing the battery to a battery compartment of the hearing aid body.

31. The hearing aid device according to claim 15, wherein the hearing aid device further comprises a hearing aid body comprising one or more actuators capable of pressing against a battery and thereby firmly fixing the battery to a battery compartment of the hearing aid body.

* * * * *